US005602369A

United States Patent [19]

Chu et al.

[11] Patent Number: 5,602,369

[45] Date of Patent: Feb. 11, 1997

[54] LAMP RECEPTACLE

[76] Inventors: Tseng-Fan Chu, No. 24, Hsin Shyue Street, Hsinchu City; Tzu-Chih Lin, No. 46,Lane 188, Dong Lin Rd., Chu Dong Chen, Hsinchu Hsien, both of Taiwan

[21] Appl. No.: 573,376

[22] Filed: Dec. 15, 1995

[51] Int. Cl.[6] ..... H01R 33/955

[52] U.S. Cl. ..... 200/51.14; 200/339; 200/51.09

[58] Field of Search ..... 200/51 R, 51.09, 200/51.11, 51.12, 51.14, 51.15, 51.16, 51.02, 339; 439/220, 221, 226, 231, 239, 240, 241, 753

[56] References Cited

U.S. PATENT DOCUMENTS 4,156,265 5/1979 Rose ..... 200/51 R 4,214,135 7/1980 Munroe ..... 200/51.14

4,668,845 5/1987 Izumi ..... 200/51 R 5,434,375 7/1995 Kawada et al. ..... 200/51 R

*Primary Examiner*—David J. Walczak

*Attorney, Agent, or Firm*—Varndell Legal Group

[57] ABSTRACT

A lamp receptacle including a receptacle body to hold a lamp bulb, a mounting base revolvably fastened to the receptacle body by a bolt, two contact blades fixed to the mounting base for connection to the power supply outlet, a first metal contact plate and second metal contact plate respectively fastened to the receptacle body and disposed in contact with the contact blades, and a third metal contact plate controlled by an ON/OFF switch on the receptacle body to connect/disconnect the first metal contact plate and the second metal contact plate.

1 Claim, 7 Drawing Sheets

LAMP RECEPTACLE

BACKGROUND AND SUMMARY OF THE INVENTION

The present invention relates to a lamp receptacle for connection to a power supply outlet to hold a lamp bulb, and relates more particularly to such a lamp receptacle which permits the receptacle body with the lamp bulb to be turned through 360° relative to the mounting base.

A lamp receptacle, as shown in FIG. 1, is generally comprised of a substantially L-shaped casing having a socket at one end for mounting a lamp bulb, two contact blades at an opposite end for connection to a power supply outlet, and an ON/OFF switch at the back in the middle for power control. This structure of lamp receptacle is not adjustable. When the lamp receptacle is installed, the angular position of the lamp bulb can not be adjusted.

It is the major object of the present invention to provide a lamp receptacle which permits the receptacle body with the lamp bulb to be turned through 360° relative to the mounting base. According to the preferred embodiment of the present invention, the lamp receptacle comprises a receptacle body to hold a lamp bulb, a mounting base revolvably fastened to the receptacle body by a bolt, two contact blades fixed to the mounting base for connection to a power supply outlet, a first metal contact plate and a second metal contact plate respectively fastened to the receptacle body and disposed in contact with the contact blades, and a third metal contact plate controlled by an ON/OFF switch on the receptacle body to connect/disconnect the first metal contact plate and the second metal contact plate.

DETAILED DESCRIPTION OF THE PREFERRED EMBODIMENT

Figure 1:
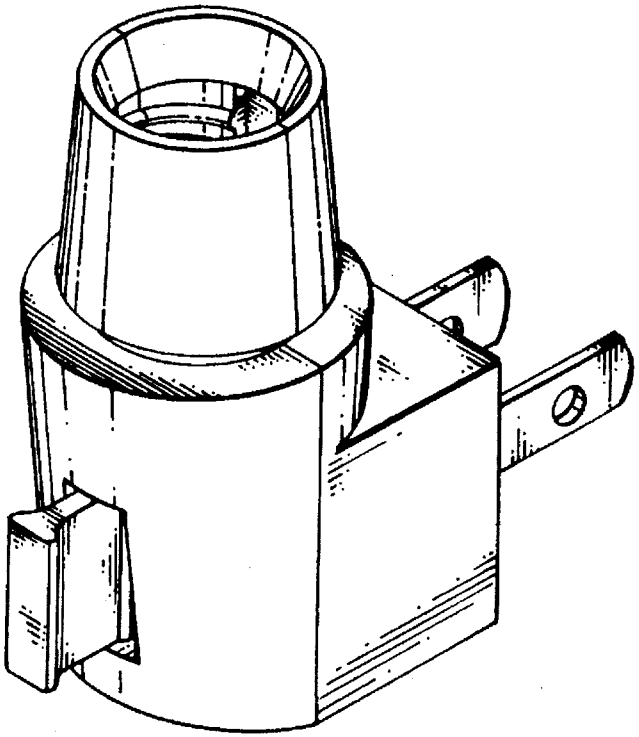
Fig. 1 PRIOR ART
FIG. 1 shows a lamp receptacle according to the prior art.
Figure 2:
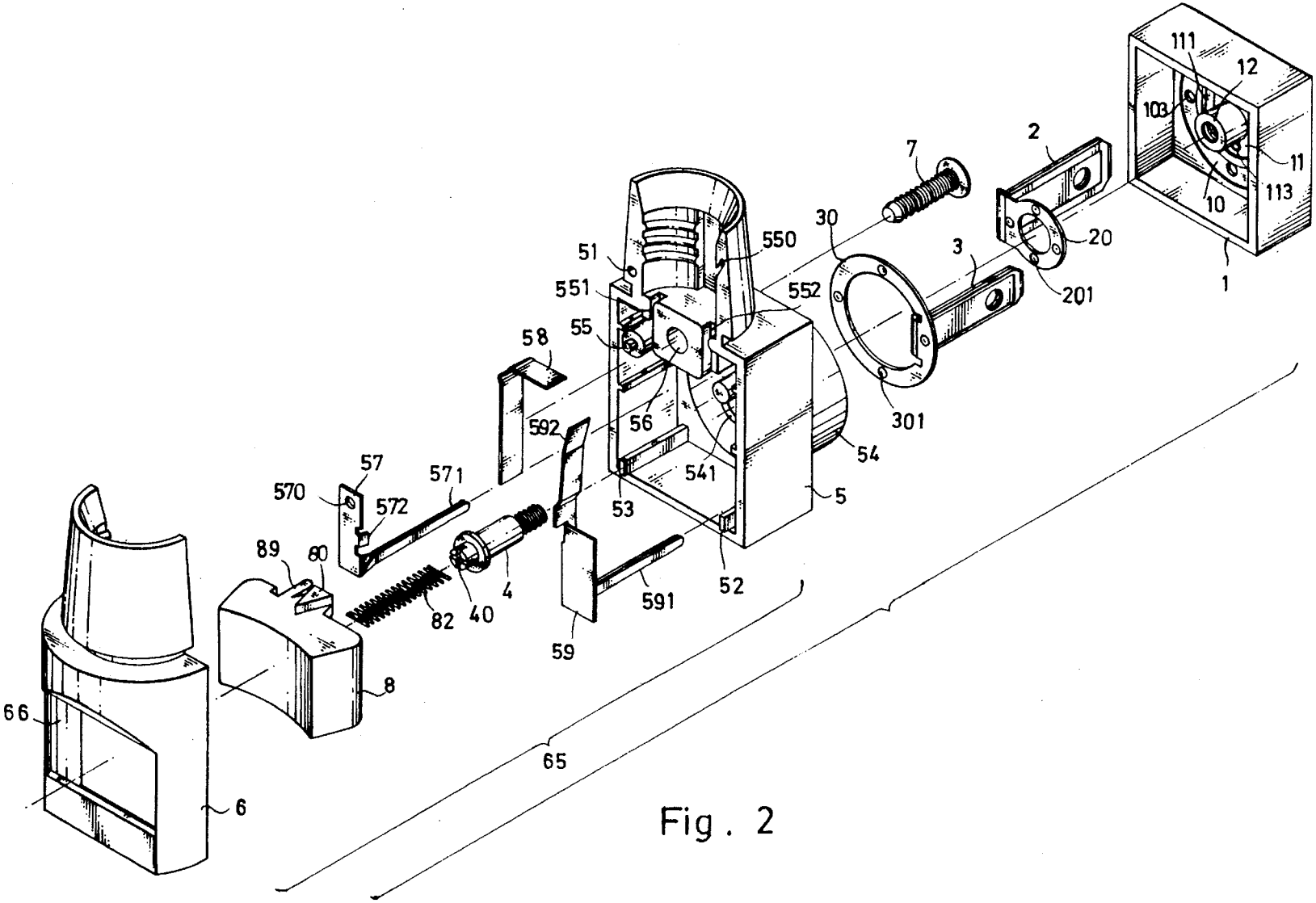
FIG. 2 is an exploded view of a lamp receptacle according to the present invention.

Referring to FIG. 2 to 6, a lamp receptacle is shown comprised of a mounting base 1, a first contact blade 2, a second contact blade 3, a receptacle body 65, a bolt 4, a screw 7, and an ON/OFF switch 8. The mounting base 1 comprises a first annular groove 10, a second annular groove

Figure 3:
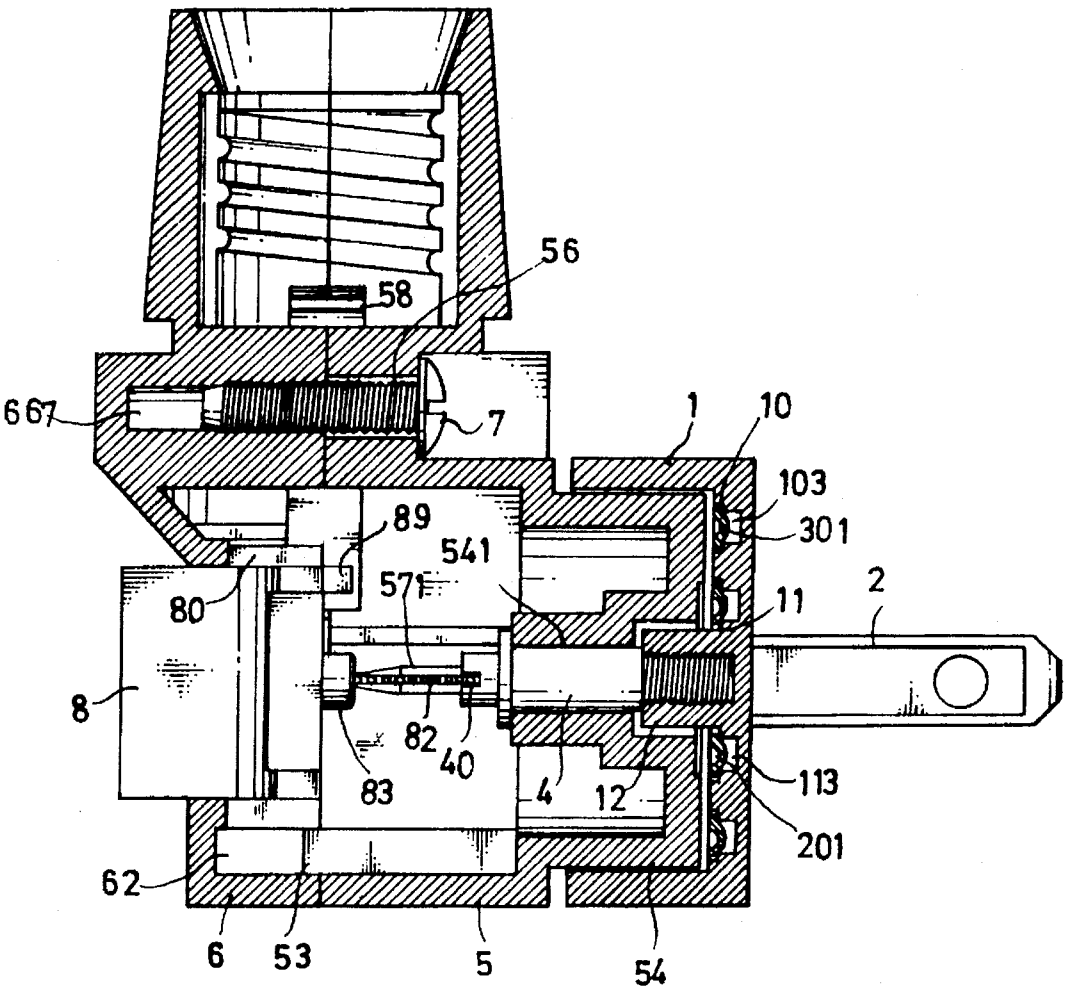
FIG. 3 is a sectional assembly view of the lamp receptacle shown in FIG. 2.
Figure 4:
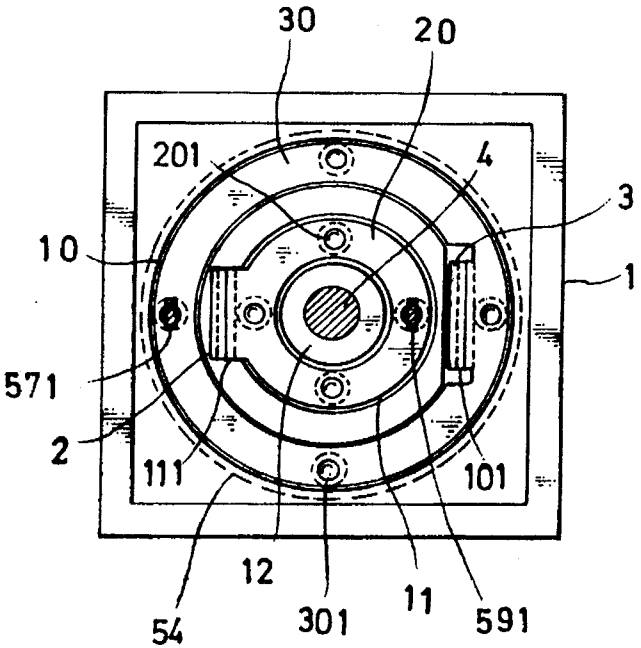
FIG. 4 is a front plain view of the mounting base showing the first contact blade and the second contact blade installed according to the present invention.
Figure 5:
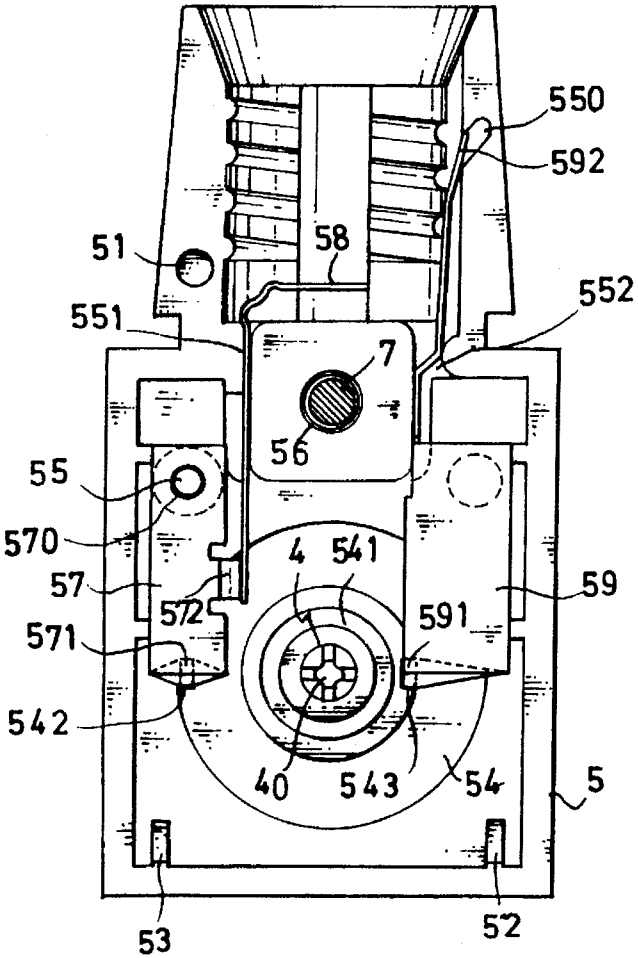
FIG. 5 is a rear side view of the front half shell according to the present invention.

11 concentrically disposed within the first annular groove 10, a first blade mounting slot 101 through the first annular groove 10, a second blade mounting slot 111 through the second annular groove 11, an upright female screw 12 at the center for mounting the bolt 4 (see FIGS. 3 and 4). The first contact blade 2 is inserted through the second blade mounting slot 111, having a locating ring 20 at one end fitted into the second annular groove 11. The locating ring 20 has at least four equiangularly spaced recessed portions 201 respectively fitted into respective recessed portions 113 in the second annular groove 11. The second contact blade 3 is inserted through the first blade mounting slot 101, having a locating ring 30 at one end fitted into the first annular groove 10. The locating ring 30 of the second contact blade 3 has at least four equiangularly spaced recessed portions 301 respectively fitted into respective recessed portions 103 in the first annular groove 10. The receptacle body 65 is for mounting a lamp bulb and comprised of a front half shell 5 and a rear half shell 6. By fitting respective raised portions 61, 52, 53, 55 into respective recessed portions 62, 63, 51 and threading the screw 7 into respective screw holes 56 and 667, the front half shell 5 and the rear half shell 6 are fastened together. The front half shell 5 comprises a tubular;front coupling portion 54 defining an axle hole 541. The bolt 4 is inserted through the axle hole 541 of the tubular front coupling portion 54 and then threaded into the female screw 12 to fix the front half shell 5 and the mounting base 1 together. The front half shell 5 has a plurality of contact mounting grooves 550, 551, and 552. The rear half shell 6 has a plurality of contact mounting grooves 650, 651, and 652. The rear half shell 6 further comprises switch mounting hole 66 and two locating grooves 660 and 661 for mounting the ON/OFF switch 8. The ON/OFF switch 8 has two locating blocks 80 and 81 at two opposite locations, and a bottom stub stem 83. When the ON/OFF switch 8 is mounted in the key switch mounting hole 66, the locating blocks 80 and 81 are respectively inserted into the locating grooves 660 and 661, and a spring 82 is supported between the bottom stub stem of the ON/OFF switch 8 and the head 40 of the bolt 4. The front half shell 5 has a plurality of contact mounting grooves 550, 551, and 552. Three metal contact plates, namely, the first metal contact plate 57, the second metal contact plate 58, and the third metal contact plate 59 are respectively fastened to the contact mounting grooves 550, 551 and 552 of the front half shell 5 and the contact mounting grooves 650, 651 and 652 of the rear half shell 6. The first metal contact plate 57 has a projecting rod 571 at one end fitted into a hole 52 on the tubular front coupling portion 54 and disposed in contact with one recessed portion 301 of the locating ring 30 of the second contact blade 3 and a round hole 570 at an opposite end coupled to a projection 55 on the front half shell 5. The third metal contact plate 59 has a projecting rod 591 at one end fitted into a hole 43 on the tubular front coupling portion 54 and disposed in contact with one recessed portion 201 of the locating ring 20 of the first contact blade 2 and a tip 592 at an opposite end fastened to the mounting groove 550.

Figure 7:
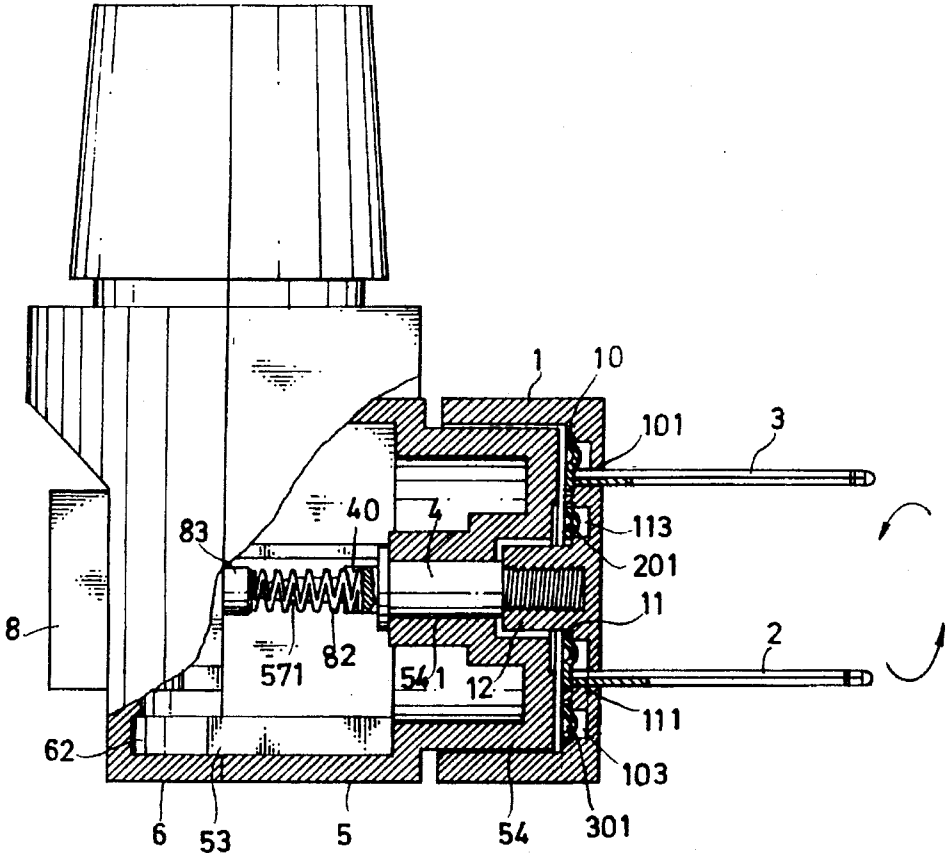
FIG. 7 shows the mounting base turned relative to the receptacle body according to the present invention.
Figure 6:
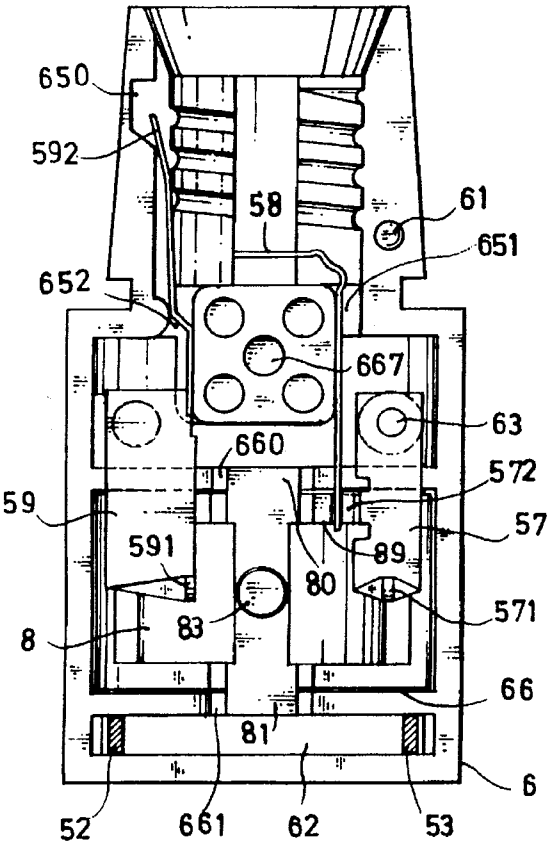
FIG. 6 is a front view of the rear half shell according to the present invention.

Referring to FIG. 7, the mounting base 1 can be turned through 360° relative to the receptacle body 65 to change the angular position of the lamp bulb relative to the contact blades 2 and 3.

Figure 9:
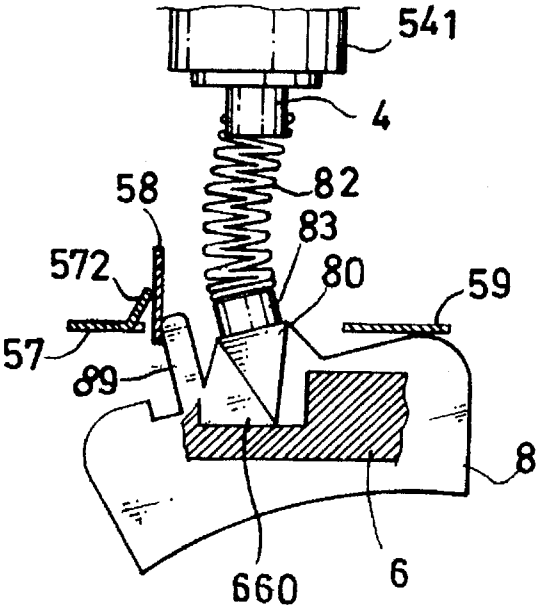
FIG. 9 shows the ON/OFF switch switched on according to the present invention.
Figure 8:
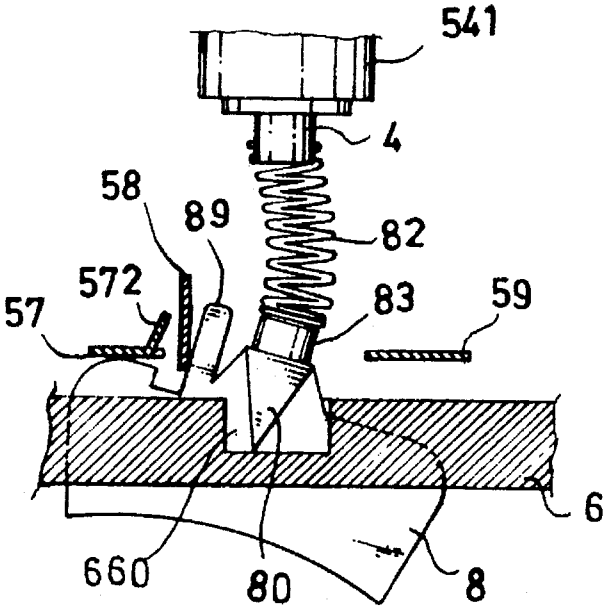
FIG. 8 shows the ON/OFF switch switched off according to the present invention.
Figure 10:
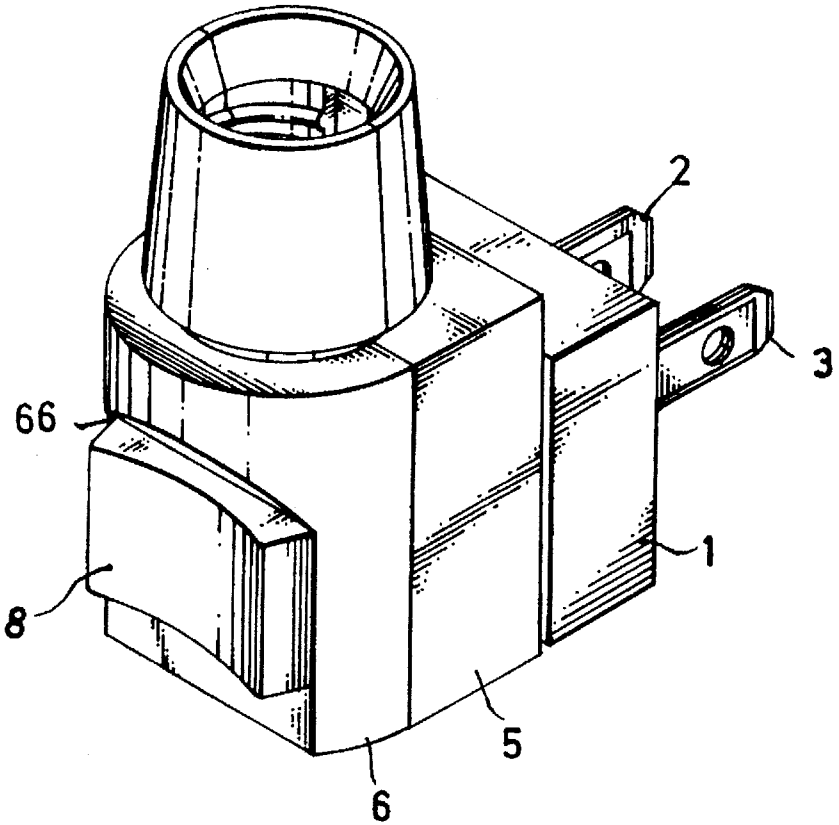
FIG. 10 is an elevational view of the lamp receptacle shown in FIG. 2.

Referring to FIGS. 8 and 9, when the ON/OFF switch 8 is depressed in one direction, the actuating rod, referenced by 89, of the ON/OFF switch 8 is forced to move the second metal contact plate 58, causing it to contact a projection 572 on the first metal contact plate 57, and therefore the electric circuit of the lamp receptacle is on. When the ON/OFF switch 8 is depressed in the reversed direction, the actuating rod 89 is released from the second metal contact plate 58, and therefore the second metal contact plate 58 is disconnected from the first metal contact plate 57, and the electric circuit of the lamp receptacle is off.

We claim:

1. A lamp receptacle, comprising:

a mounting base having an inside with a center, an upright female screw on said center of said inside, a first annular groove around said upright female screw, a plurality of first recessed portions equiangularly spaced in said first annular groove, a second annular groove concentrically disposed about said first annular groove, a plurality of second recessed portions equiangularly spaced in said second annular groove, a first blade mounting slot in said first annular groove, and a second blade mounting slot in said second annular groove;

a first contact blade and a second contact blade respectively mounted on said mounting base for connection to a power supply outlet, said first contact blade inserted through said first blade mounting slot, fixed in place and having a locating ring at one end fitted into said first annular groove; said locating ring of said first contact blade having at least four equiangularly spaced recessed portions respectively fitted into said first recessed portions of said first contact blade; said second contact blade inserted through said second blade mounting slot, fixed in place and having a locating ring at one end fitted into said second annular groove; said locating ring of said second contact blade having at least four equiangularly spaced recessed portions respectively fitted into said second recessed portions of said second contact blade;

a receptacle body connected to said mounting base and adapted to hold a lamp bulb, said receptacle body including a front half shell and a rear half shell connected together by screw means, said front half shell comprising a tubular front coupling portion defining an axle hole, said front half shell and said rear half shell each having a plurality of contact mounting grooves, said rear half shell having a switch mounting hole and two locating grooves for mounting an ON/OFF switch;

a bolt inserted through said axle hole of said tubular front coupling portion and threaded into said female screw of said mounting base to fix said front half shell and said mounting base together and permitting said mounting base to be turned relative to said receptacle body;

a first metal contact plate, a second metal contact plate, and a third metal contact plate respectively fastened to said contact mounting grooves of said front half shell and said rear half shell, said first metal contact plate having a projecting rod at one end fitted into a hole on said tubular front coupling portion of said front half shell and disposed in contact with one recessed portion of said locating ring of said second contact blade and a round hole at an opposite end coupled to a projection on said front half shell, said third metal contact plate having a projecting rod at one end fitted into a hole on said tubular front coupling portion of said front half shell and disposed in contact with one recessed portion of said locating ring of said first contact blade and a tip at an opposite end fastened to one mounting groove on said front half shell; and an ON/OFF switch mounted in said switch mounting hole of said rear half shell, said ON/OFF switch comprising two locating blocks respectively inserted into said locating grooves of said rear half shell, a bottom stub stem, a spring having one end connected to said bottom stub stem and an opposite end connected to said bolt, and an actuating rod; said actuating rod of said ON/OFF switch being forced to move said second metal contact plate into contact with said first metal contact plate to close a circuit when said ON/OFF switch is switched on; said actuating rod of said ON/OFF switch being released from said second metal contact plate and causing said second metal contact plate to disconnect from said first metal contact plate when said ON/OFF switch is switched off.

* * * * *